US006276829B1

(12) United States Patent
Popp

(10) Patent No.: US 6,276,829 B1
(45) Date of Patent: Aug. 21, 2001

(54) TRANSPORT BAG

(76) Inventor: Eberhard Popp, Erlenstrasse 8, D-97890 Bad Mergenheim (DE)

( * ) Notice: Subject to any disclaimer, the term of this patent is extended or adjusted under 35 U.S.C. 154(b) by 0 days.

(21) Appl. No.: 09/280,880

(22) Filed: Mar. 29, 1999

(30) Foreign Application Priority Data

Apr. 4, 1998 (DE) ..... 198 15 192

(51) Int. Cl.[7] ..... B65D 33/14

(52) U.S. Cl. ..... 383/24; 383/16; 383/18; 383/23

(58) Field of Search ..... 200/9.4; 383/2, 383/4, 12, 16, 18, 21, 23, 24, 76

(56) References Cited

U.S. PATENT DOCUMENTS 77,201 * 4/1868 Ludlow ..... 383/16 X
1,490,922 * 4/1924 Groh ..... 383/18
5,437,384 * 8/1995 Farrell ..... 220/9.4 X
5,622,277 * 4/1997 Van Griezen et al. ..... 220/9.4 X
5,746,343 * 5/1998 Waltke et al. ..... 220/9.4

FOREIGN PATENT DOCUMENTS

22091 * of 1912 (GB) ..... 383/18

* cited by examiner

*Primary Examiner*—Jes F. Pascua
(74) *Attorney, Agent, or Firm*—Edwin D. Schindler

(57) ABSTRACT

Transport bag, in particular for storing and transporting bulk materials, which comprises a flexible material and has the shape of an open, hollow cuboid on the top side, said transport bag being equipped with a rope control (5), a loop (4) or eyelet is affixed to one of the four comers adjacent to the top side, rope control (5) is guided through the loop (4) or eyelet and is affixed to the corner (7) located below or is guided through a loop or eyelet at the corner below (7) and is affixed to the diagonally opposed bottom comer (6).

20 Claims, 4 Drawing Sheets

TRANSPORT BAG

BACKGROUND OF THE INVENTION

1. Technical Field of the Invention

Figure 1:
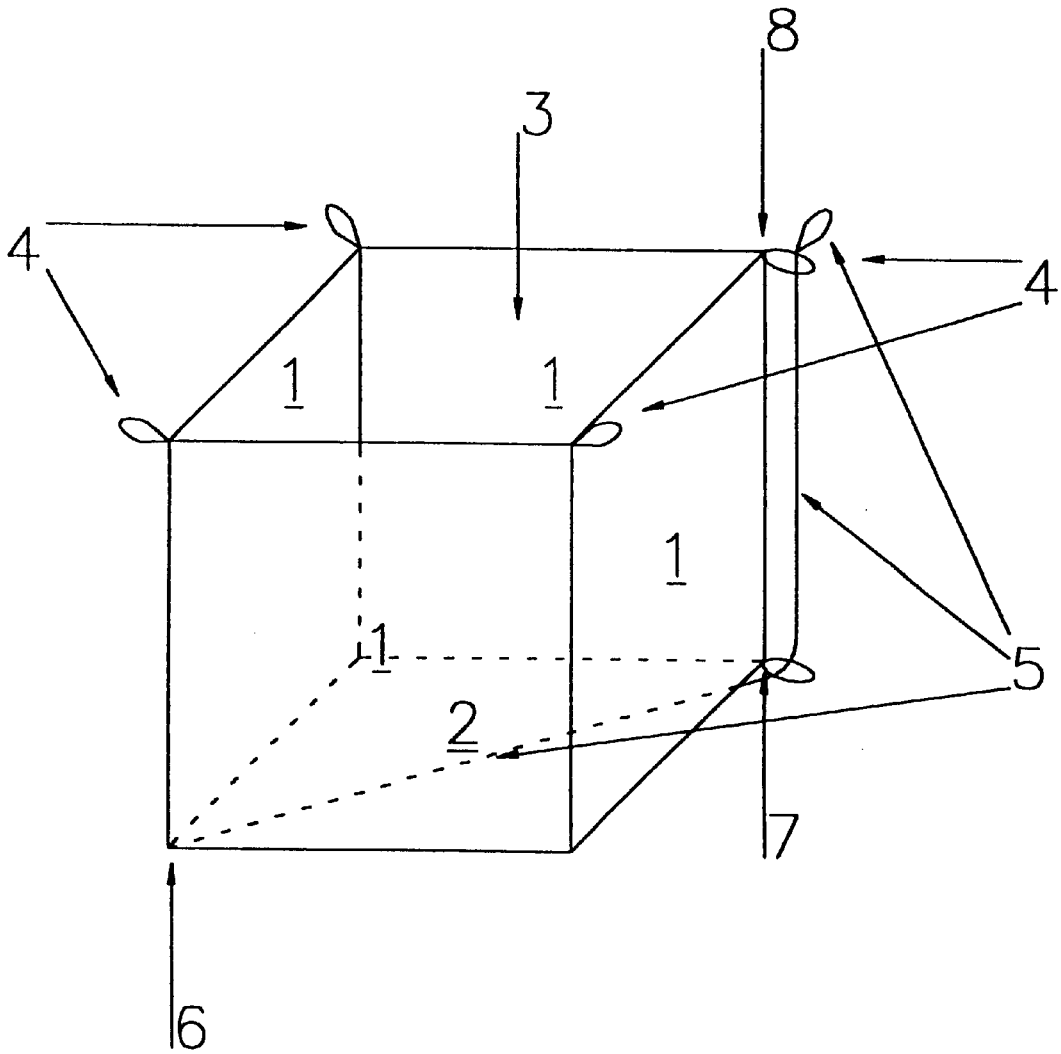

The invention concerns a transport bag, in particular for storing and transporting bulk materials, which comprises a flexible material and has the shape of an open, hollow cuboid on the top side.

2. Description of the Prior Art

The building rubbish which occurs on job sites is usually collected in special bulk containers, which comprise metal, in particular steel plate, and is then transported away. The containers are transported on special trucks, which are required not only for transporting the filled container but which due to the large bulk and own weight are also required for transporting empty containers, which contributes, when such containers are used, to the costs incurred. On the other hand, transport bags made from a flexible material (Big Bags) are also known which have, for example, the shape of an open, hollow cuboid or cube at the top and are also suitable for storing and transporting building rubbish or other bulk materials. The advantage lies in particular therein that they have a comparatively low own weight and can be folded up after emptying and stored compactly in this way and of being, where necessary, transportable to the next place of use, without a separate truck being needed. Moreover, such transport bags can adapt, due to their flexibility, by way of contrast to rigid containers, to the contents up to a certain degree. Thus, on the one hand, the space required for only partially filled transport bags is reduced, on the other, the dimensions of the objects, which such a flexible transport bag can receive, are not subjected to a fully inflexible limit.

To use the simple and space-saving storage mid transport possibilities of such a transport bag, as a precondition it must be completely emptied after use. Particularly this aspect presents a problem because by simply lifting the transport bag at its top corners or edges does not tilt it sufficiently to empty its contents entirely which is why further measures are required that thus far have stood in the way of its advantageous usage as a replacement for conventional rubbish containers.

SUMMARY OF THE INVENTION

Against this background it is the object of the present invention to design a transport bag in such a way that it can be emptied completely in a simple way.

This task is solved therein that the transport bag is provided with a rope control, a loop or an eyelet is affixed to one of the four corners adjacent to the top side, the rope control is guided through the loop or eyelet and is affixed to the corner located below or guided through a loop or eyelet at the corner located below and is affixed to the diagonally opposed bottom corner.

The central idea of the present invention bases on the consideration that to empty completely a cuboidal transport bag, it has to be tilted to such a degree that in a tilted condition the lowest corner or edge, which is normally adjacent to the aperture forming the top side, assumes a lower position than every corner or edge normally located at the base. To achieve such a position of the transport bag in a simple manner, the invention foresees the use of a rope control which acts upon one of the bottom corners and pulls the transport bag into the desired position. The invention proposes two concrete alternative possible embodiments for the rope control in that in both cases it is guided through a loop or eyelet affixed to one of the top corners of the transport bag and is fixed either to the corner located perpendicularly below or there is likewise guided through a loop or eyelet and is affixed to the corner on the bottom of the transport bag diagonally opposed to this bottom corner. Both proposed configurations enable the transport bag, via the rope control, to be brought into a position suitable for complete emptying.

In the case of the first-named variant, the transport bag according to the invention is tilted into a position with the rope control in which the lateral edge connected to the rope control is directed upwards and the transport bag is emptied via the corner diagonally opposed to this edge adjacent to the bag's apertures. Owing to the flexibility of the material and the play that the rope control has in the loop or eyelet, the bottom corner of the transport bag, to which the rope control is fixed, during the emptying process, is drawn into an at least equally high position as the top corner to which the loop or eyelet attaches. Because this bottom corner is connected to the diagonally opposed corner, which in a tilted condition of the transport bag is directed downwards, via the bottom side normally forming the base of the transport bag, the transport bag assumes a position in which complete emptying is possible.

With the alternative variant of the transport bag according to the invention, the bottom corner of the transport bag, which points downwards dating emptying, is additionally pulled upward and thus the bag is reliably and completely emptied.

Both proposed variants of the transport bag according to the invention are thus suitable for using it for storing and transporting bulk materials, to then completely empty it simply via the rope control, for instance, by means of any lifting device with sufficient carrying force, for instance, a crane, where a single operator is sufficient, to then fold it up and to store it space-savingly and cost-effectively due to his low weight and bulk or to transport it to a new place of use. In respect of the material for the transport bag according to the invention both woven fabric as well as a tarpaulin or sheet are possible. The relationship between length, width and height of the straight-shaped transport bag is largely optional in the frame of the conception according to the invention.

In respect of a large capacity and rapid emptying of the transport bag, however, it is advantageous to employ the cuboidal transport bag with a square base area. In particular, in the case of a cuboid with a square base area, whose height corresponds to half the edge length of the base area, the capacity of the transport bag according to the invention can be maximized for a given quantity of material for the side walls and floor and thus an accompanying empty weight. By selecting a greater height of the transport bag, for example, a full edge length of the square base area, which results in a cubical transport bag, by way of contrast one obtains a more favorable relationship between storage and transport bulk and the floor space of the transport bag. Usually, one will select a height value for the cuboidal transport bag which ties between the two named extremes.

Lifting and loading the transport bag in a full condition can be done, for example, by a crane or a loading crane integrated in the truck used for transport. Therefore, in an advantageous further embodiment of the invention the transport bag is provided at the four corners adjacent to its top side respectively with a loop or eyelet or hook, which present application points for lifting the transport bag. Here, the loop or eyelet at one of the four corners can be identical to the one which is used to guide the rope control according to the invention.

A basic problem of flexible transport bags consists therein that in an empty condition, due to a lack of self-rigidity, they collapse, which makes filling them considerably more difficult. Here, to take remedial action, the transport bag according to the invention, in an advantageous further embodiment of the invention, is equipped with a supporting frame in which the transport bag can be suspended for filling. Such a supporting frame can comprise, for example, a standing, horizontally oriented, rectangular frame on four posts of the height of the transport bag, whose aperture exceeds slightly the dimensions of the base area and aperture of the associated transport bag. The transport bag can then, for example, be hooked to the top edge of the supporting frame with its hook or, if necessary, also be suspended by its loops or eyelets on pegs correspondingly disposed on the corners of the supporting frame or longitudinally disposed tubes. In this way, the transport bag according to the invention can also be filled simply in an empty condition, when it has obtained self-rigidity through its charge, the supporting frame can again be removed without difficulties. It is especially advantageous for storing and transporting the supporting frame if it comprises a multiplicity of component parts and can again be dismounted after use. Basically, a supporting frame that can be inserted into the transport bag is conceivable.

BRIEF DESCRIPTION OF THE DRAWING FIGURES

Further details, features and advantages of the invention can be taken from the following description part in which with the aid of the drawings a typical embodiment of the invention is explained in greater detail. They show FIG. 1 a diagrammatic representation showing on principle a transport bag according to the invention, FIG. 2 a view of a transport bag according to the invention with a supporting frame in a perspective representation, FIG. 3 a perspective representation of the emptying process of a transport bag according to the invention; and, FIG. 4 a perspective representation of the emptying process of a transport bag according to the invention, in which loops thereof are replaced by, or otherwise shown as, hooks.

DETAILED DESCRIPTION OF THE DRAWING FIGURES AND PREFERRED EMBODIMENTS

FIG. 1 shows a diagrammatic representation of the basic structure of the transport bag according to the invention, where the hidden edges are indicated by means of a dashed line. In the example, the transport bag according to the invention has an essentially cubical design and has four side walls (1) as well as a square base (2) which are connected to one another at the edges and are made from a flexible material, preferably a plastic sheet of high bearing strength. The aperture (3) remaining at the top side of the cube serves for charging and the subsequent emptying of the transport bag according to the invention. To the four top corners of the transport bag, adjacent to said aperture (3) is affixed respectively one loop (4) by which the charged transport bag can be lifted with a suitable lifting device. The transport bag is equipped with a rope control (5) which is affixed to the bottom corner (6) adjacent to base (2) from where it extends via base (2) to the diagonally opposed corner (7), where it is guided through a loop or eyelet. From here, rope control (5) extends along a cube edge approximately perpendicularly upward to corner (8) adjacent to aperture (3), where it is guided through one of loops (4). In the alternative embodiment of the transport bag according to the invention rope control (5) would be solely affixed at point (7) and at point (8) guided through one of loops (4).

Figure 2:
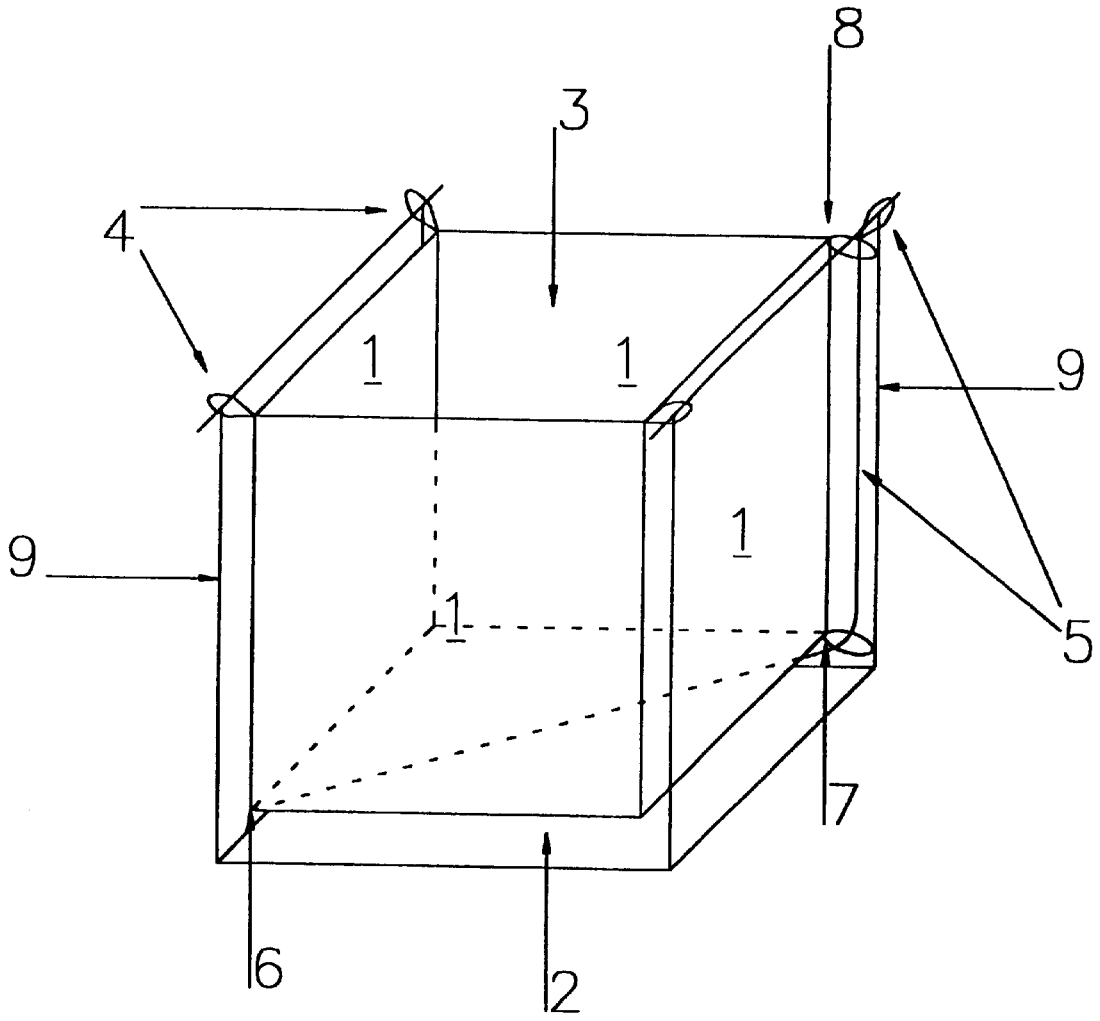

FIG. 2 shows a perspective representation of a transport bag according to the invention in use, which in an empty condition is placed at a place of use. To prevent it from collapsing due to the flexibility of the wall material, which would considerably aggravate in a disadvantageous way charging, a supporting frame (9) is set up around it to which it is hooked by means of its loops (4) and which lends it in the degree necessary support and stability.

Figure 3:
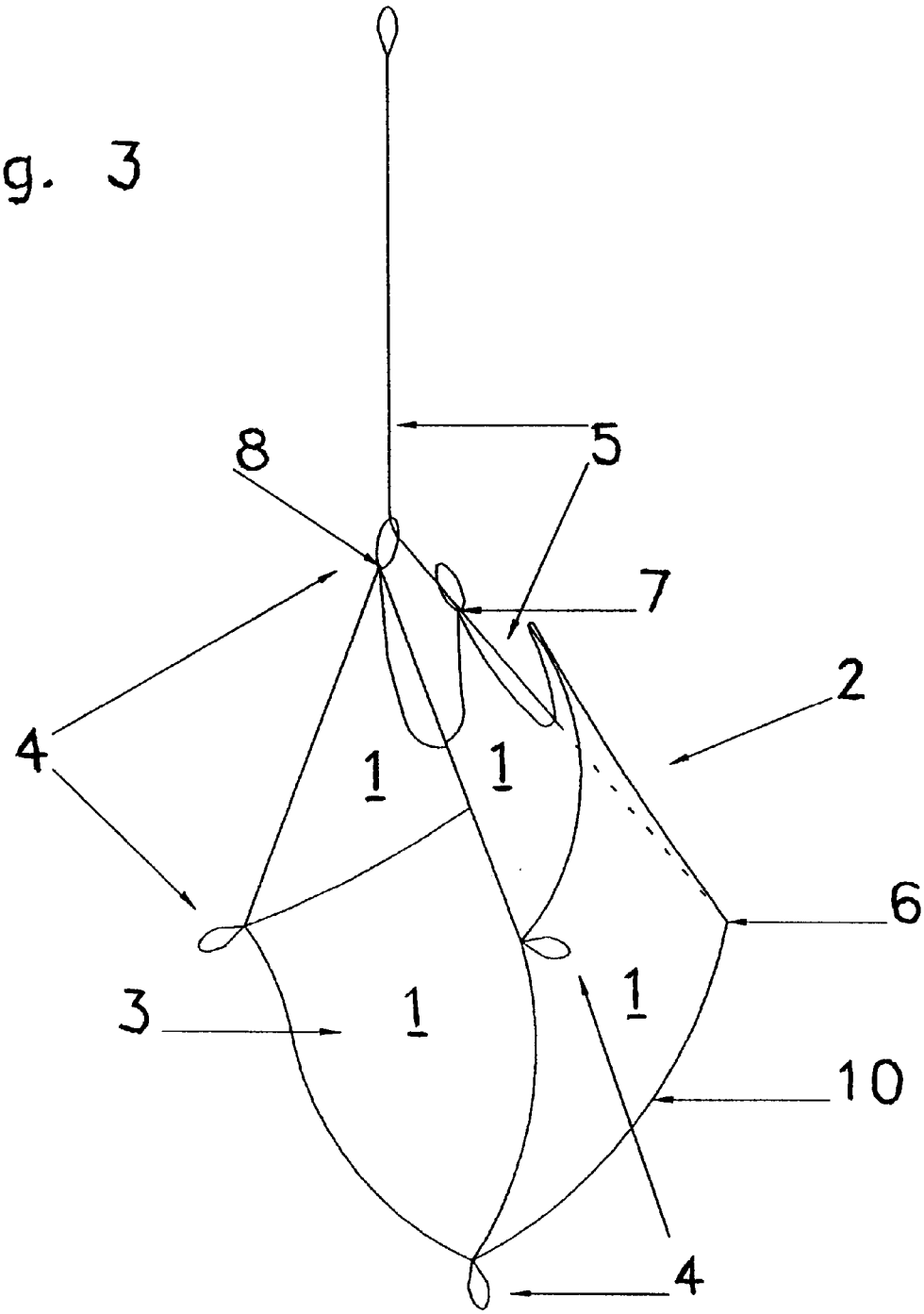

FIG. 3 shows a perspective representation of the transport bag according to the invention during the emptying process. One recognizes that during emptying the transport bag is deformed by rope control (5) in such a way, which is lifted upward at its endwise loop by a lifting device that is not shown here, so that edge (10), which in a tilted position is located below, falls away toward aperture (3) so that the bulk materials in the transport bag, which are not shown here, drop out completely under the influence of gravity.

Figure 4:
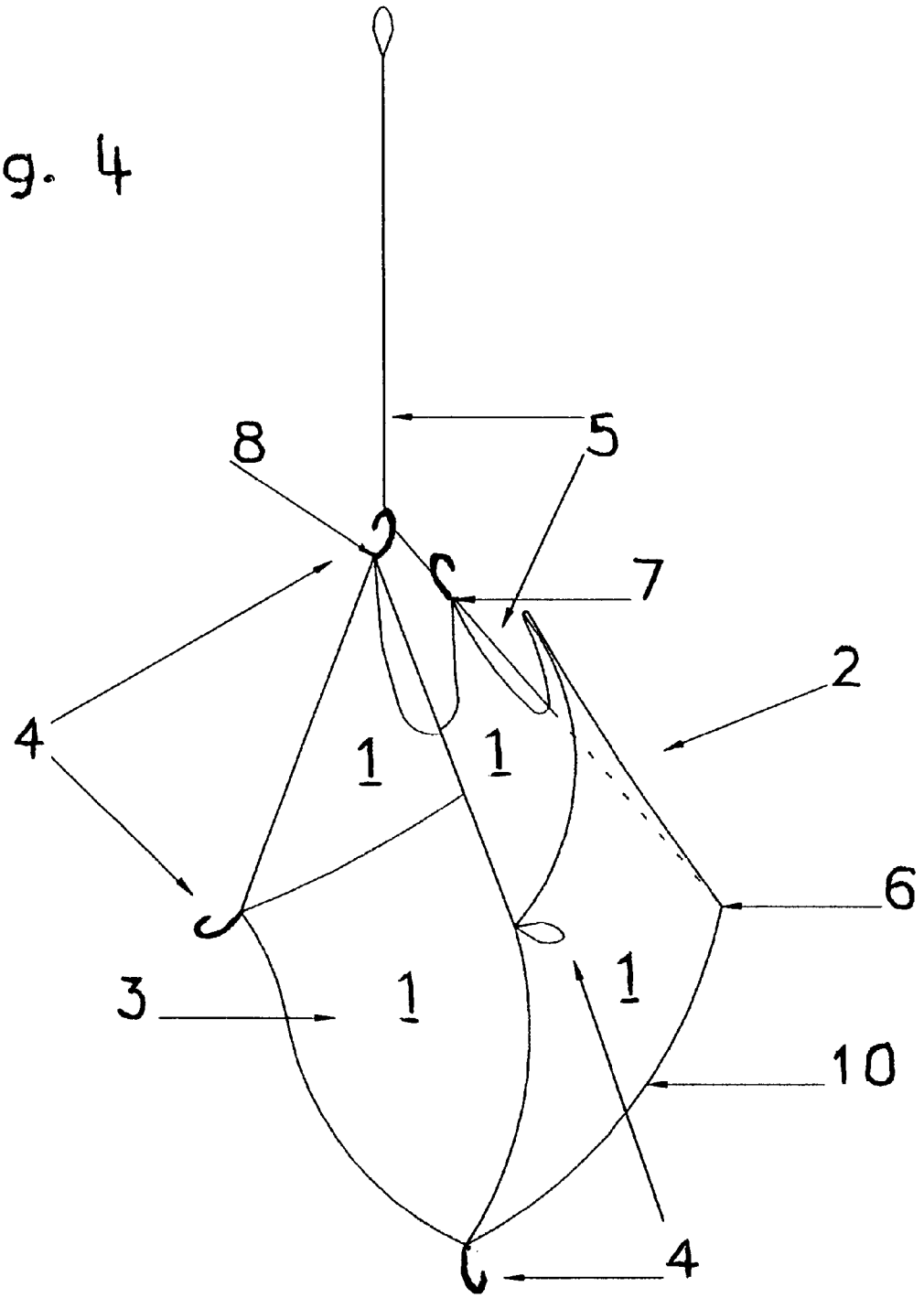

FIG. 4 is a perspective view of the preferred embodiment of the transport bag of FIGS. 1–3, in which loops (4) have been replaced by, or otherwise shown as, hooks (4A).

As a result one obtains a collapsible transport bag for bulk materials, which with the aid of its rope control can be completely emptied in a simple manner and which, in an emptied condition, is simple and cost-effective to store and to transport due to its low own weight and space requirements.

What is claimed is:

1. A transport bag for storing and transporting bulk materials, comprising:

a flexible material shaped as a hollow cuboid with four corners adjacent a top side thereof, said hollow cuboid being open;

a rope control; and, a loop affixed to one corner of the four corners of said hollow cuboid adjacent to the top side thereof, said rope control being guided through said loop and affixed to a first lower corner located at a bottom side of said hollow cuboid and is affixed to a second lower corner, said second lower corner being diagonally opposed to said first lower corner.

2. The transport bag for storing and transporting bulk materials according to claim 1, wherein said flexible material is a woven fabric.

3. The transport bag for storing and transporting bulk materials according to claim 1, wherein said flexible material is a tarpaulin.

4. The transport bag for storing and transporting bulk materials according to claim 1, wherein said flexible material is a sheet.

5. The transport bag for storing and transporting bulk materials according to claim 1, wherein said hollow cuboid has a square base area.

6. The transport bag for storing and transporting bulk materials according to claim 5, wherein said hollow cuboid has a height of between one-half and a full edge length of said square base area.

7. The transport bag for storing and transporting bulk materials according to claim 1, wherein said loop is an eyelet.

8. The transport bag for storing and transporting bulk materials according to claim 1, wherein said four corners of said hollow cuboid adjacent to the top side thereof each have a loop.

9. The transport bag for storing and transporting bulk materials according to claim 8, wherein said loop at each of said four corners is a hook.

10. The transport bag for storing and transporting bulk materials according to claim 1, further comprising a supporting frame suspended within said transport bag.

11. A transport bag for storing and transporting bulk materials, comprising:

a flexible material shaped as a hollow cuboid with four corners adjacent a top side thereof, said hollow cuboid being open;

a rope control;

a lower loop;

an upper loop affixed to one corner of the four corners of said hollow cuboid adjacent to the top side thereof, said rope control being guided through said upper loop and then guided through said lower loop, said lower loop being located at a first lower corner located at a bottom side of said hollow cuboid, said rope control being affixed to a second lower corner, said second lower corner being diagonally opposed to said first lower corner.

12. The transport bag for storing and transporting bulk materials according to claim 11, wherein said flexible material is a woven fabric.

13. The transport bag for storing and transporting bulk materials according to claim 11, wherein said flexible material is a tarpaulin.

14. The transport bag for storing and transporting bulk materials according to claim 11, wherein said flexible material is a sheet.

15. The transport bag for storing and transporting bulk materials according to claim 11, wherein said hollow cuboid has a square base area.

16. The transport bag for storing and transporting bulk materials according to claim 15, wherein said hollow cuboid has a height of between one-half and a full edge length of said square base area.

17. The transport bag for storing and transporting bulk materials according to claim 11, wherein at least one of said upper loop and said lower loop is an eyelet.

18. The transport bag for storing and transporting bulk materials according to claim 11, wherein said four corners of said hollow cuboid adjacent to the top side thereof each have one said upper loop.

19. The transport bag for storing and transporting bulk materials according to claim 18, wherein said upper loop at each of said four corners is a hook.

20. The transport bag for storing and transporting bulk materials according to claim 11, further comprising a supporting frame suspended within said transport bag.

* * * * *